US005678154A

United States Patent [19]

Chen et al.

[11] Patent Number: 5,678,154

[45] Date of Patent: Oct. 14, 1997

[54] TRANSPARENCY FEED WITH AMORPHOUS FLUOROPOLYMER COATED PRESSURE ROLL

[75] Inventors: Jiann Hsing Chen, Fairport; Lawrence Paul Demejo, Rochester; Borden Mills, Webster; Gary Frederick Roberts, Macedon, all of N.Y.

[73] Assignee: Eastman Kodak Company, Rochester, N.Y.

[21] Appl. No.: 674,227

[22] Filed: Jun. 28, 1996

[51] Int. Cl.[6] ..... G03G 15/20

[52] U.S. Cl. ..... 399/331; 492/56

[58] Field of Search ..... 399/328, 330, 399/333, 331; 219/216, 469–470; 430/124, 126, 98, 99; 492/17, 18, 20, 25, 26, 46, 53, 56; 432/60

[56] References Cited

U.S. PATENT DOCUMENTS

| | | | |
|---|---|---|---|
| 4,948,851 | 8/1990 | Squire | 526/247 |
| 5,035,950 | 7/1991 | DelRosario | 428/421 |
| 5,208,293 | 5/1993 | Oki et al. | 525/199 |
| 5,227,853 | 7/1993 | Proulx et al. | 399/339 |
| 5,256,507 | 10/1993 | Aslam et al. | 430/42 |

*Primary Examiner*—Matthew S. Smith
*Attorney, Agent, or Firm*—John R. Everett

[57] ABSTRACT

A fuser for fixing electrostatographic images comprising a fusing roll and a pressure roll is disclosed. The pressure roll has a rigid metal core coated with an amorphous fluoropolymer. The fluoropolymer has a surface energy up to 16 dyne/cm and a coefficient of friction from 0.4 to 1.0.

7 Claims, No Drawings

TRANSPARENCY FEED WITH AMORPHOUS FLUOROPOLYMER COATED PRESSURE ROLL

RELATED APPLICATIONS

The present case relates to the following U.S. patent applications filed at the same time as the present application: U.S. patent application No. 08/673448 entitled "Process for Controlling Gloss in Electrostatic Images" filed in the name of Chen and U.S. patent application No. 08/674222 entitled "Amorphous Fluoropolymer Coated Fusing Member" filed in the name of Chen et al.

FIELD OF THE INVENTION

This invention relates to electrostatographic imaging.

BACKGROUND OF THE INVENTION

Heat-softenable toners are widely used in imaging methods such as electrostatography, wherein electrically charged toner is deposited imagewise on a dielectric or photoconductive element bearing an electrostatic latent image. Most often in such methods, the toner is then transferred to a surface of another substrate, such as, e.g., a receiver sheet comprising paper or a transparent film, where it is then fixed in place to yield the final desired toner image.

When heat-softenable toners, comprising, e.g., thermoplastic polymeric binders, are employed, the usual method of fixing the toner in place involves applying heat to the toner once it is on the receiver sheet surface to soften the toner and then allowing or causing the toner to cool.

One such well-known fusing method comprises passing the toner-bearing receiver sheet through the nip formed by a pair of opposing rolls, at least one of which (usually referred to as a fuser roll) is heated and contacts the toner-bearing surface of the receiver sheet in order to heat and soften the toner. The other roll (usually referred to as a pressure roll) serves to press the receiver sheet into contact with the fuser roll.

One type of receiver sheet is transparent plastic and is referred to simply as a transparency. Frequently such receivers cannot reliably be fed through the above mentioned nip. Failure to feed can result from a number of different factors including transparency type, oil feed to the fuser roll and fusing temperature. The basic mechanism of transparency feeding into the fuser nip is gripping of the transparency lead edge by the fuser and pressure rolls, overcoming the slippery state from the silicone release oil and separating the rolls to allow entrance of the transparency. Failure of the transparency to enter the nip can cause copy jams and adversely affect image quality. Transparency feeding reliability is a critical task for a heated roll fuser in electrophotography, particularly color electrophotography.

Many factors which can improve transparency feeding have an adverse effect on other fuser performance criteria such as image release, transparency image projection quality and fuser roll and pressure roll contamination by the toner. These factors include transparency oil load (mg/imaged transparency), nip width, fuser roll temperature and velocity of the transparency. Oil load has a significant effect on transparency feeding. However reduction of oil load is not practical. A certain oil load is needed to effect transparency image release.

Anodized aluminum pressure rolls have been used to provide fused color images in the Kodak ColorEdge Copier Duplicator with improvement in transparency feeding. However, these rolls tend to suffer from heavy toner build up and copy jams when using certain release oils. Silverstone pressure rolls also have been used in the color electrophotographic image fixing with reduced toner contamination on the pressure roll. However, based on our studies, these rolls show inadequate transparency feeding latitude even at very low oil loads.

Accordingly, there is a need for a new pressure roll material and a method to increase transparency feeding latitude and reduce toner contamination on the pressure roll for color electrophotographic image fixing.

SUMMARY OF THE INVENTION

The present invention provides a fuser for fixing electrostatographic images comprising a fusing roll and a pressure roll having a rigid metal core coated with an amorphous fluoropolymer having a surface energy up to 16 dyne/cm and a coefficient of friction from 0.4 to 1.0.

The improved pressure roll makes possible a method for feeding a transparent receiver sheet bearing an unfused toner image through a fusing station, comprising the steps of:

A. providing a fusing station having a nip formed by contact between a heated fusing roll and a pressure roll;

B. passing the transparent receiver through the nip thereby fusing the toner image on the transparent receiver; characterized in that the pressure roll comprises a metal cylindrical core coated with an amorphous fluoropolymer having a surface energy up to 16 dyne/cm and a coefficient of friction from 0.4 to 1.0.

The novel pressure roll improves transparency feeding at increased oil loads. This invention also makes possible color imaged transparency feeding reliability and reduction of toner contamination on pressure rolls thereby avoiding exit copy jams.

DETAILS OF THE INVENTION

Useful amorphous fluoropolymer have the structure:

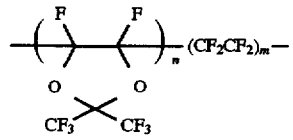

wherein m is 20 mole percent or 35 mole percent and n is 65 mole percent or 80 mole percent.

Amorphous fluoropolymers according to structure above are available from E. I. Dupont with glass transition temperatures at 160° C. (Teflon AF 1600) or 240° C. (Teflon 2400). These materials have unusual properties such as low surface energy, low moisture absorption and solution coating capability.

The surface energy was measured by a contact angle measurement using a NRL Contact Angle Goniometer Model 100-0115. The coefficient of friction was measured using a smooth steel block sliding against the amorphous fluoropolymer coating. The resulting coefficient was the force required to maintain motion divided by the weight of the block.

The novel pressure roll provided by this invention can be used with a wide variety of heated fuser roll configurations know in electrostatography such as disclosed in U.S. Patent Nos. 4,976,877; 5,474,821 and 5,464,698. A particular useful fuser roll assembly bears a thick conformable coating of at least 2.5 mm. A useful fuser roll is disclosed in U.S. Pat. No. 5,464,698.

The fuser roll has a core, a base cushion superimposed on the core and an outer layer superimposed on the base cushion.

The outer or "covercoat" layer comprises a cured fluorocarbon random copolymer having subunits with the following general structures:

The outer layer includes particulate filler comprising tin oxide and additional particulate selected from alkali metal oxides, alkali metal hydroxides, and combinations of alkali metal oxides and hydroxides.

The fusing roll uses a release oil, such as PDMS oil, to prevent offset, that is, to aid the roll in releasing from the toner it contacts during the fusing operation. During use, the oil is continuously coated over the surface of the fuser roll in contact with the toner image. The fuser roll of the invention can be used with polydimethylsiloxane or mercapto functionalized polydimethylsiloxane release oils at normally used application loads or at reduced application loads, from about 0.5 mg/copy to 10 mg/copy (the copy is 8.5 by 11 inch 20 pound bond paper.

The outer layer of the fuser roll of the invention is substantially resistant to release oil induced swelling. Changes in size due to swelling is less than 0.1 to 1.0 percent, usually 0.01 to 0.1 percent.

The thicknesses of the base cushion and outer layers and the composition of the base cushion layer can be chosen so that the base cushion layer can provide the desired resilience to the fuser roll, and the outer layer can flex to conform to that resilience. The thickness of the base cushion and outer layers are chosen with consideration of the requirements of the particular application intended. Usually, the outer layer would be thinner than the base cushion layer. For example, base cushion layer thicknesses in the range from 0.6 to 5.0 mm have been found to be appropriate for various applications. In some embodiments the base cushion layer is about 2.5 mm thick, and the outer layer is from about 25 to 35 micrometers thick.

Suitable materials for the base cushion layer include any of the wide variety of materials previously used for base cushion layers, such as the condensation cured polydimethylsiloxane marketed as EC4952 by Emerson Cuming. An example of an addition cured silicone rubber is Silastic J RTV marketed by Dow Corning applied over a silane primer DC-1200 also marketed by Dow Corning.

The core of the fuser roll comprises any rigid metal or plastic substance. Metals are preferred when the fuser roll is to be internally heated, because of their generally higher thermal conductivity. Suitable core materials include, e.g., aluminum, steel, various alloys, and polymeric materials such as thermoset resins, with or without fiber reinforcement.

The pressure roll core is generally a metal such as steel, aluminum, copper and stainless steel.

This invention is further described by reference the following examples.

Transparency feeding test results consisted of three oil loads: 1) the lowest oil load at which a failure, either a non-feed, buckling prior to feed, or wrinkle, occurred; 2) the highest oil load at which a successful feed occurred and 3) and average oil load of 10 successful feeds, run at the same oil load, which was intended to be just less than the "Lowest Failure" oil load. In all oil load testing, oil was applied to the fuser roll before, but not during, each trial. Each test consisted of three phases:

The first was a rough identification of failure threshold. Oil was applied to the fuser, using a rotating wick, for a chosen number of fuser roll rotations. If the fuser roll stalled during oiling, it was hand rotated at a similar speed. In case of a non-feed, hand rotation of the fuser roll would eventually result in feeding. This initial phase was used to identify the minimum number of oiled fuser roll rotations at which unsuccessful feeding would occur. Transparencies themselves were saved as oil load samples.

The experimenter would then attempt to feed 10 transparencies in a row at an oil load just below the threshold of failure. If a failure occurred, that sample would be saved. This phase would then restart at the next lower number of rotations. Once all 10 feeds were successful, samples of trials 1, 5 and 10 would be taken as oil load samples. The resulting "10/10" oil load would be the average of these three.

In the third phase, the experimenter would make sure that the previous 10 trials were run at the highest possible oil load, by increasing the wick engagement time incrementally to see if failure would quickly recur. If it did, the test was complete. If no failure occurred in 10 trials, additional samples would be taken to define a new, higher "10/10" oil load. Then, again, fuser roll rotations with the wick engaged would be increased further to see if failure occurred, and so on.

The most critical result was the lowest oil load at which failure occurred. The average load at which 10 successful trials were run was also significant. The difference between these two loads represented feeding uncertainty. Usually, this difference was minimal. The highest load at which a successful feed occurred was also a measure of feeding uncertainty.

EXAMPLE 1

A transparency feeding test was carried out on an electrophotographic image fixing breadboard having a nip formed between a pressure roll and a fusing roll. The path of the transparency in the breadboard, from toner transfer to fusing was similar to that of the Kodak ColorEdge Copier Duplicator. The set points of the breadboard were:

Drive: pressure roll driven by motor and coupling

Fusing Release oil: 350 centistoke, Dow Corning DC-200

Fuser roll: 2.5 mm thick Silastic E silicone rubber available from Dow Corning is injection molded on an aluminum core Fuser roll diameter: 1.7 inch (42.5 mm)

Fuser roll durometer: 40 shore A

Fuser roll temperature: 375° F. (190.6° C.)

Toner: Kodak ColorEdge Copier Duplicator toner Nip width: 3.75 mm ( 0.15 inch).

Pressure roll diameter: 37.5 mm (1.5 inch)

Pressure roll speed: 31.8 mm (1.25 inch) per second

Maximum toner laydown: 2.1 mg/cm$^2$

The pressure roll coating materials Teflon AF 1600 and Teflon AF 2400 were coated using ring coating techniques. The coatings were on aluminum cylindrical cores.

Conventional semi-crystalline Teflon coatings include Silverstone (polytetrafluoroethylene resins or PTFE), Supra Silverstone (blend of polytetrafluoroethylene and perfluoroalkyl vinyl ether (PTFE and PFA), and conductive Silverstone (Supra Silverstone plus conductive filler). They were coated on separate pressure rolls by conventional spray coating methods on an aluminum cylindrical core.

Table 1 lists the pressure roll coating materials that were tested. The table lists, in mg/transparency, 1) the lowest oil load at which a transparency feeding failure occurred, 2) the highest oil load at which a successful feed occurred and 3) an average oil load of 10 successful consecutive feeds, ran at the same oil load. This load was just less than the lowest oil load. The most critical result was the lowest oil load at which feeding failure occurred. The average load at which 10 successful trials were ran was also significant. Table 1 indicates both amorphous Teflon AFs coated pressure rolls had the largest "lowest oil load" and 10/10 oil load.

TABLE 1

| Pressure roll coating | Lowest oil load failure | Highest Successful oil load | 10/10 oil load |
|---|---|---|---|
| Teflon AF 1600 | 32.2 mg | 34.2 mg | 27.0 mg |
| Teflon AF 2400 | 18.8 | 15.2 | 14.0 |
| Anodized Al | 15.5 | 14.6 | 12.9 |
| Silverstone | 6.6 | not tested | not tested |
| Supra Silverstone | 13.2 | 12.5 | 8.9 |
| Conductive Silverstone | 10.0 | 7.8 | 7.2 |

EXAMPLE 2

The breadboard set points were the same as in example 1. A Teflon AF 1600 coated pressure roll was ran with plain bond paper for a total of 100,000 sheets. The same transparency feeding latitude test was performed at 0, 25K, 50K and 100K intervals. This test was conducted to show that plain paper feeding had no adverse effect on transparency feeding. Table 2 indicates after 100,000 copies, transparency feeding latitude of Teflon AF 1600 was still robust.

TABLE 2

| Copy count | Lowest oil load failure | Highest oil load success | 10/10 oil load |
|---|---|---|---|
| 0 | 26.0 mg | 33.0 mg | 22.5 mg |
| 25K | 27.4 | 30.1 | 25.2 |
| 50K | 22.5 | 26.9 | 19.5 |
| 100K | 19.6 | 25.4 | 17.3 |

EXAMPLE 3

Pressure roll hot release test

The breadboard set points and tests used in Example 1 were used. A wedge-shaped image was used for imaging. It was ran across the photoreceptor in the direction of increasing image width. A single color toner laydown ( 0.7 mg/cm$^2$) of Kodak ColorEdge Copier Duplicator toner was used for imaging.

TABLE 3

| Pressure roll coating | Hot release |
|---|---|
| Anodized aluminum | poor |
| Conductive Silverstone | good |
| Teflon AF 1600 | excellent |

Table 3 indicates that the anodized aluminum coated pressure roll can feed transparency better than conductive Supra Silverstone, but can not release toner. The conductive Supra Silverstone coating can release toner, but cannot feed transparency. Teflon AF 1600 can feed transparency but also can release toner.

The invention has been described in detail with particular reference to a preferred embodiment thereof. However it will be understood that variations and modifications can be effected within the spirit and scope of the invention as described hereinabove and defined in the appended claims.

We claim:

1. A fuser for fixing electrostatographic images comprising a fusing roll and a pressure roll having a rigid metal core coated with an amorphous fluoropolymer having a surface energy up to 16 dyne/cm and a coefficient of friction from 0.4 to 1.0.

2. The pressure roll of claim 1 wherein the rigid core is selected from a cylinder of stainless steel, copper or aluminum.

3. The pressure roll of claim 1 or 2 wherein the amorphous fluoropolymer has the structure (1):

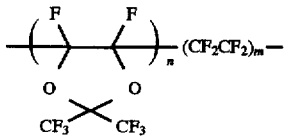

wherein m is 20 mole percent or 35 mole percent and n is 65 mole percent or 80 mole percent.

4. A process for feeding a transparent receiver sheet bearing an unfused toner image through a fusing station, comprising the steps of:

A. providing a fusing station having a nip formed by contact between a heated fusing roll and a pressure roll;

B. passing the transparent receiver through the nip thereby fusing the toner image on the transparent receiver; characterized in that the pressure roll comprises a metal cylindrical core coated with an amorphous fluoropolymer having a surface energy up to 16 dyne/cm and a coefficient of friction from 0.4 to 1.0.

5. The method of claim 4 wherein a release oil is applied to the fuser roll as the transparent receiver passes through the nip.

6. The method of claim 4 wherein a release oil is applied to the fuser roll before the transparent receiver passes through the nip.

7. The method of claim 5 or 6 wherein from 0.1 to 35 milligrams of oil is left on the receiver after passing through the nip.

* * * * *